US005559593A

United States Patent [19]

Yoshinaga et al.

[11] Patent Number: 5,559,593

[45] Date of Patent: Sep. 24, 1996

[54] CLEANING DEVICE FOR AN IMAGE FORMING APPARATUS

[75] Inventors: Hiroshi Yoshinaga, Ichikawa; Akira Sawada, Yokohama, both of Japan

[73] Assignee: Ricoh Company, Ltd., Tokyo, Japan

[21] Appl. No.: 441,609

[22] Filed: May 15, 1995

[30] Foreign Application Priority Data

| | | | |
|---|---|---|---|
| May 13, 1994 | [JP] | Japan | 6-124363 |
| Sep. 20, 1994 | [JP] | Japan | 6-253026 |
| Apr. 3, 1995 | [JP] | Japan | 7-101710 |

[51] Int. Cl.[6] ..... G03G 21/00

[52] U.S. Cl. ..... 355/296; 355/297

[58] Field of Search ..... 355/296, 297, 355/298; 118/652

[56] References Cited

U.S. PATENT DOCUMENTS 4,769,676 9/1988 Mukai et al. .

FOREIGN PATENT DOCUMENTS 55-40405 3/1980 Japan .
55-55376 4/1980 Japan .
56-126880 10/1981 Japan .
62-67577 3/1987 Japan .
62-203183 9/1987 Japan .
63-48587 3/1988 Japan .

OTHER PUBLICATIONS

*Patent Abstracts of Japan*, vol. 12, No. 166 (P704), Pub. May 19, 1988, JP62–279383.

*Primary Examiner*—R. L. Moses

*Attorney, Agent, or Firm*—Oblon, Spivak, McClelland, Maier & Neustadt, P.C.

[57] ABSTRACT

In an image forming apparatus of the type using spherical toner or toner whose mean volume grain size is 7 μm or less, a cleaning device has at least one cleaning roller facing, but not contacting, a photoconductive element. An electric field for causing the toner to fly from the photoconductive element to the roller is formed between the element and the roller. An alternating field, DC or AC-biased DC bias voltage is applied to the roller. Particularly, a voltage having a rectangular waveform is applied to the roller.

11 Claims, 15 Drawing Sheets

CLEANING DEVICE FOR AN IMAGE FORMING APPARATUS

FIELD OF THE INVENTION

1. Background of the Invention

The present invention relates to a copier, facsimile apparatus, laser printer or similar image forming apparatus and, more particularly, to a cleaning device for an image forming apparatus of the type using spherical toner or toner having a mean volume grain size of 7 μm or less.

2. Discussion of the Background

In an electrophotographic image forming apparatus, for example, a conventional cleaning device has a cleaning blade or a rotatable fur brush contacting a photoconductive drum or similar image carrier. After the transfer of a toner image from the drum to a paper, toner remaining on the drum is removed and collected by the blade or fur brush. Various implementations have been proposed in order to improve the ability of the cleaning device. For example, Japanese Patent Laid-Open Publication No. 57-111576 teaches toner provided with an assistant, e.g., zinc stearate or similar fatty acid metal salt so as to reduce a coefficient of friction between the blade and the drum. This, however, brings about a problem that the reduced coefficient of friction causes the toner to slip on the drum, resulting in a blurred, partly lost or otherwise disfigured image.

Japanese Patent Laid-Open Publication Nos. 2-106780 and 3-269478 each proposes a cleaning blade whose edge is made of a material having a small coefficient of friction. This kind of blade is expected to be free from turn-over and chattering which invite defective cleaning. Japanese Patent Laid-Open Publication No. 1-229281 discloses an arrangement which causes some toner to deposit on the background of a photoconductive element and thereby reduces the coefficient of friction between the element and a cleaning blade. This approach enhances the cleaning ability by preventing the blade from being turned over. However, when the toner is deposited on the background, the toner is consumed in a great amount relative to the number of copies. In the worst case, the toner is fully consumed due to idling.

It has also been proposed to improve the cleaning device for the purpose of miniaturizing the image forming apparatus as well as for other purposes. For example, Japanese Patent Laid-Open Publication 62-203182 teaches a non-contact type developing device capable of effecting development and cleaning at the same time. Japanese Patent Laid-Open Publication No. 62-203183 discloses a non-contact type cleaning device interposed between a charger and a developing roller included in a developing device. This cleaning device cleans a photoconductive element charged by the charger and includes a cleaning roller whose surface roughness is 0.1 μm to 5 μ. The cleaning roller is spaced apart from the photoconductive element by a gap of about 200 μm. A blade collects the toner removed by the roller. Only an AC power source applies to the roller an AC voltage having a frequency of 2 kHz and a peak-to-peak voltage of 1.6 kV. In this condition, the toner remaining in the charged, but non-exposed, area of the photoconductive element is caused to fly toward the roller due to a potential difference between the non-exposed area and the DC component of the roller.

Another non-contact type cleaning device is disclosed in Japanese Patent Laid-Open publication No. 55-40405 and includes a cleaning roller not contacting a photoconductive element. A voltage for forming an electric field of $10^2$ V/cm to $10^5$ V/cm is formed between the roller and the photoconductive element.

It has also been customary to use toner having a high resistance, but not charged, in developing a latent image electrostatically formed on a photoconductive surface. Regarding this kind of developing system, Japanese Patent Laid-Open publication No. 55-55376 proposes a cleaning device which removes, after the transfer of a toner image to an acceptor, the remaining toner by charging it and then transferring it to a cleaning roller by an electric field. Specifically, the photoconductive surface and roller are spaced apart by a gap of 0.3 mm to 2 mm, and a voltage ranging from 200 V to 2,000 V is applied to between them.

Japanese Patent Laid-Open Publication No. 56-126880 discloses a cleaning device for an image forming apparatus of the type using a single component, magnetic insulative developer. The device removes the developer from a photoconductor after an image developed by the developer has been transferred to a paper or similar transfer medium. Specifically, the device includes a nonmagnetic metallic sleeve accommodating fixed magnetic poles therein and adjoining a photoconductor. An alternating field is formed between each pole and the photoconductor so as to collect the developer at the pole. The sleeve is spaced apart from the photoconductor by, for example, a gap of 300 μm to 400 μm. An alternating voltage having a sinusoidal waveform and a peak-to-peak voltage of about 1 kV to 2 kV, center value of 500 V to 1,000 V, and frequency of 100 Hz to 1 kHz is applied to between the sleeve and the photoconductor. Further, Japanese Patent Laid-Open Publication No. 62-67577 proposes a cleaning device having a metallic roller facing a photoconductor at a distance of 400 μm, and applying to the roller an AC voltage having a frequency of 1 kHz and peak-to-peak voltage of 3 kV and a DC voltage of −400 V to −600 V superposed on the AC voltage.

It has recently been proposed to use spherical toner or fine toner having a mean volume mean grain size of 7 μm or less in order to improve the image quality, among others. Because spherical toner is usually produced by polymerization, it has a more even surface and is chargeable more stably that toner produced by pulverization. Hence, spherical toner scarcely contaminates the background of an image. Further, line toner is superior to toner of ordinary grain size in respect of the MTF (Modulation Transfer Function) of an image. This kind of toner is, therefore, feasible for an image forming apparatus using a digital writing system whose writing density is approaching that of printing.

When the spherical toner or the fine toner is used, the cleaning device with a fur brush has a drawback that the toner cannot be easily removed from the fur brush. The toner is, therefore, apt to form a film on the fur brush and obstructs cleaning. Moreover, the fur brush is apt to damage the surface of the image carrier and thereby increases the coefficient of friction. This particularly leads to defective cleaning when use is made of this kind of toner. As for the cleaning device using a blade, defective cleaning attributable to the wear and chattering of the blade is apt to occur particularly when this kind of toner is used. In addition, the blade causes the image carrier to wear and thereby changes the developing characteristic.

In light of the above, the cleaning device with a blade may be combined with the scheme taught in previously stated Laid-Open Publication No. 57-111576, i.e., toner provided with a fatty acid metal salt. However, when it comes to the spherical toner or the fine, the cleaning device cannot reduce the coefficient of friction between the blade and the image carrier or to reduce the turn-over and chattering of the blade to a satisfactory degree.

The cleaning device, whether it be of the blade type or of the fur brush type, causes an irregular density distribution, or jitter, to occur in an image. This is because the image carrier and cleaning :member, contacting each other, are different in linear velocity, resulting in changes in the speed of the image carrier.

The image forming apparatus taught in Laid-Open Publication No. 62-203182 has a problem that a bias potential should be guaranteed between the charge potential of the image carrier and the potential after exposure, because the non-contact type developing and device effects development cleaning at the same time. It is, therefore, difficult to implement both the developing ability and the cleaning ability while using the spherical toner or the fine toner which firmly adheres to the image carrier. This is far more difficult when halftone should be rendered by 1-dot multilevel writing.

The non-contact type cleaning device disclosed in Laid-Open Publication No. 62-203183 is interposed between the charger and the developing roller to remove the charged toner. With this kind of device, it is impossible to use a charge roller, charge blade, charge brush or similar contact type charging member which produces a minimum of ozone, because such a member would be smeared. Even a corona charger or similar non-contact type charger is easily smeared at the time of charging because the toner is charged, resulting in low image quality. Further, when a pigment is used to color the toner or when a magnetic substance is contained in the toner, the toner loses transmissibility. As a result, it is likely that the toner remaining after image transfer and the toner attributable to a jam prevent an image from being formed. Such toner is at least apt to render the potential after image writing and, therefore, the resulting image unstable when halftone should be rendered by 1-dot multilevel writing. Furthermore, when the fine toner is used, the charger, charging the remaining toner from above the toner, deposits an excessive charge because the surface area for a unit volume increases. This further aggravates the cleaning ability. This is also true with the spherical toner having a smooth surface and, therefore, causing a minimum of leak to occur.

SUMMARY OF THE INVENTION

It is, therefore, an object of the present invention to provide a cleaning device for an image forming apparatus of the type using the spherical toner or the fine toner, and capable of allowing an attractive image to be formed while cleaning an image carrier in a desirable manner.

It is another object of the present invention to provide a cleaning device for an image forming apparatus and capable of removing, after image transfer, even toner of the same polarity as a bias voltage from an image carrier.

In accordance with the present invention, a cleaning device for an image forming apparatus and for removing toner left on an image carrier after a toner image has been transferred from the image carrier to a transfer medium has a cleaning member spaced apart from the surface of the image carrier by a predetermined gap, and a electric field forming circuit for forming between the cleaning member and the image carrier an electric field for causing the toner to fly from the image carrier toward the cleaning member.

Also, in accordance with the present invention, a cleaning device for an image forming apparatus and for removing toner left on an image carrier after a toner image has been transferred from the image carrier to a transfer medium has a plurality of cleaning members spaced apart from the surface of the image carrier by a predetermined gap, and a bias applying circuit for applying a bias voltage of particular polarity to each of the cleaning members.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Preferred embodiments of the cleaning device in accordance with the present invention will be described with reference to the accompanying drawings.

1st Embodiment

Figure 1:
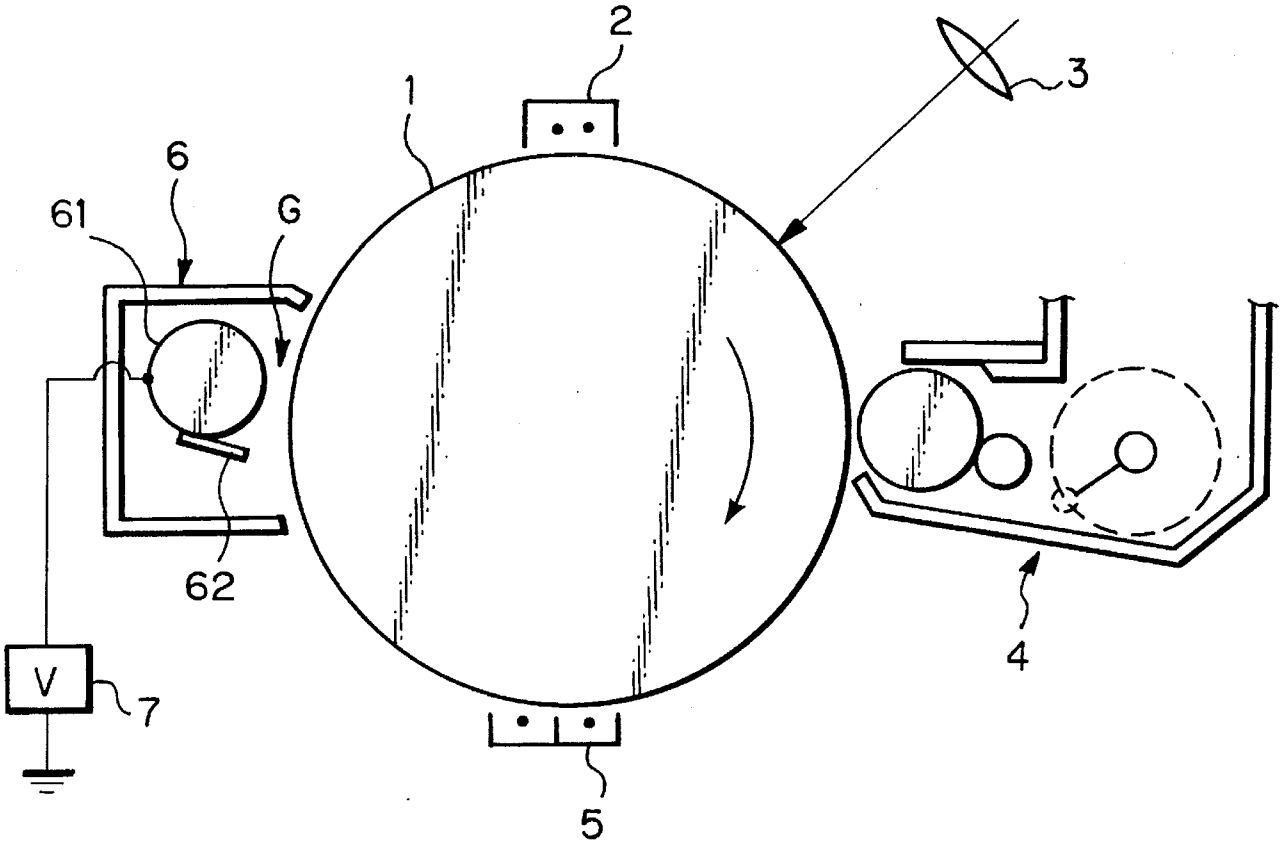
FIG. 1 is a section of an image forming apparatus to which a first embodiment of the cleaning device in accordance with the present invention is applied.

Referring to FIG. 1, an image forming apparatus to which a first embodiment is applied is shown and executes negative-to-positive development. Use is made of spherical toner produced by polymerization, as taught in Japanese Patent Laid-Open Publication No. 4-137372. The toner has a grain size of 5.0 μm or 7.0 μm. The "spherical" toner refers to toner having a shape factor (square of circumferential length/4π times of projection area) mode ranging from 1.00 to 1.05.

As shown in FIG. 1, a charger 2 uniformly charges the surface of a photoconductive element implemented as a drum 1. Optics 3 exposes the charged surface of the drum 1 imagewise and thereby forms a latent image on the drum 1. A developing device 4 develops the latent image to produce a corresponding toner image. An image transfer and paper separation unit 5 transfers the toner image to a paper and separates the paper from the drum 1. A fixing unit, not shown, fixes the toner image on the paper. After the image transfer, the toner remaining on the drum 1 is removed by a cleaning device 6. The developing device 4 is of the type charging the toner, or single component developer, to the negative polarity and effecting development without contacting the drum 1.

The cleaning device 6 has a cleaning member in the form of a roller 61, a cleaning blade 62 for removing from the roller 61 the excess toner collected from the drum 1, and a bias source 7 for applying a bias voltage for cleaning to the roller 61. The bias voltage may be a DC voltage or an AC-biased DC voltage. The roller 61 is implemented as a cylindrical rod made of stainless steel (SUS). For cleaning the drum 1, the embodiment forms a gap of 150 μm between the roller 61 and the drum 1 and uses, in the case of an AC-biased DC voltage, an AC component having a peak-to-peak voltage Vp-p of 1,500 V and a frequency of 1,000 Hz and a DC component of −750 V. Why the DC component is of the same polarity as the toner of the developing device 4, i.e., negative polarity is that most of the toner left on the drum 1 after the image transfer has been charged to the positive polarity. Table 1 shown below lists the results of cleaning tests performed with text images developed by the non-contact type developing device 4. Also shown in Table 1 are the results of similar tests effected under the same conditions except for the replacement of the cleaning device 6 with a conventional blade type or a fur brush type cleaning device. For the tests, two kinds of toner having the previously mentioned grain sizes of as small as 5 82 m and 7 μm, respectively, were used.

TABLE I

| | PRIOR ART (Blade) | | PRIOR ART (For Brush) | | Embodiment | |
|---|---|---|---|---|---|---|
| Grain Size | 5 μm | 7 μm | 5 μm | 7 μm | 5 μm | 7 μm |
| Copies | | | | | | |
| Start | o | o | o | o | o | o |
| 5000 | x | x | Δ | o | o | o |
| 10000 | | | x | o | o | o |
| 15000 | | | | Δ | o | o |
| 20000 | | | | x | o | o |
| 25000 | | | | | o | o |
| 30000 | | | | | o | o |

As Table 1 indicates, the conventional blade type device failed to clean the drum 1 except for the initial stage. When the edge of the blade has its radius of curvature increased due to wear, the condition will become more severe. Experiments showed that for amorphous toner having a mean volume grain size of 7 μm or less, the blade fails to clean the drum 1 when 10,000 printings are produced. While the fur brush type device can clean the drum 1 at the initial stage, filming occurs on the filaments of the brush due to aging. In addition, scratches sequentially appear on the drum 1 with the result that the coefficient of friction between the drum 1 and the toner increases. It was found by experiments that for the 7 μm spherical toner, the fur brush fails to clean the drum 1 when 20,000 printings are produced.

As stated above, the conventional cleaning device, whether it be of blade type or of fur brush type, forms numerous fine scratches on the drum 1 and thereby roughens the surface of the drum 1, i.e., increases the coefficient of friction. This, coupled with the wear of the blade or the toner filming on the fur brush, deteriorates the function of the cleaning member itself. It was found that even when the 7 μm toner advantageous for cleaning is used, defective cleaning occurs when more than 20,000 printings are produced.

By contrast, the cleaning device 6 successfully cleans the drum 1 even after 30,000 printings have been produced, as Table 1 indicates. Moreover, because the roller 61 is spaced apart from the drum 1 by a gap G, it does not scratch the drum 1 at all and is free from noticeable deterioration, as confirmed by experiments. In addition, because the cleaning device 6 removes the remaining toner electrically, its ability remains the same without regard to the grain size of toner.

To maintain the gap G between the roller 61 and the drum 1, use may be made of spacer rollers. This kind of implementation is sure and inexpensive.

The toner removed from the blade 62 is collected in a waste toner container, not shown. Alternatively, an arrangement may be made such that a bias voltage opposite in direction to the bias voltage for toner collection is applied to the roller 61 when part of the drum 1 corresponding to the interval between papers (non-image area) arrives at the roller 61. Then, the waste toner will be deposited on such part of the drum 1 and collected at the developing unit 4. When the DC voltage of the bias applied to the roller 61 was −200 V, the roller 61 was found not only to clean the drum 1 but also to charge the drum 1 to 900 V. With this DC voltage, therefore, it is possible to omit the charger 2 for uniformly charging the drum 1.

Figure 2A:
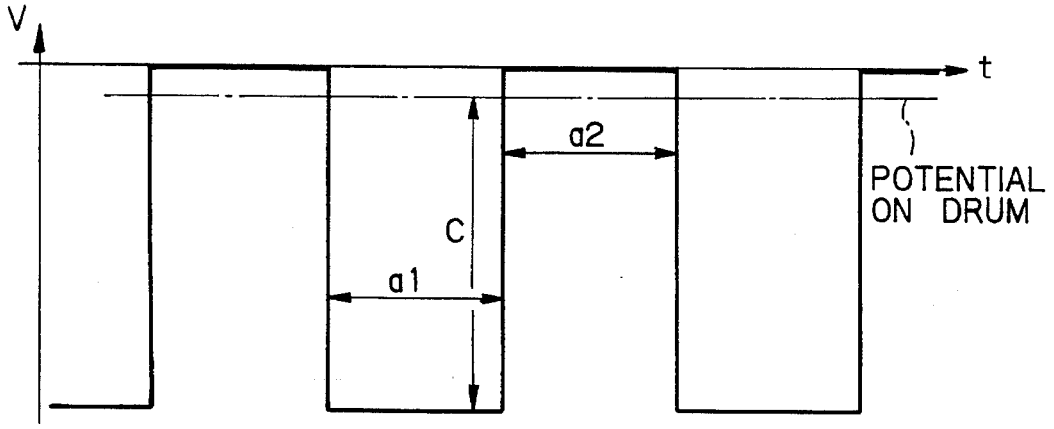
FIG. 2A is a graph showing changes in the potential of a cleaning member to occur when an electric field changes in a rectangular waveform with respect to time.

As shown in FIG. 2A, the bias from the bias source 7 may be implemented as a voltage whose size sequentially changes in a rectangular waveform. Then, an electric field whose intensity sequentially changes in a rectangular fashion will be formed between the roller 61 and the drum 1. This kind of voltage will be described in detail later. For example, a cleaning test was conducted with a bias voltage having a peak-to-peak voltage Vp-p of 2,000 V, center value of −500 V, frequency of 1,000 Hz, and a duty ratio (on:off) of 1:1, and changing in a rectangular waveform, and with spherical 5 μm toner and spherical 7 μm toner. In this condition, the cleaning unit was free from defective cleaning when more than 30,000 printings were produced. The above bias voltage forms in the gap G of 150 μm an electric field having an amplitude of $1.3\times10^7$ V/m and center value of $3.3\times10^6$ V/m.

Figure 2B:
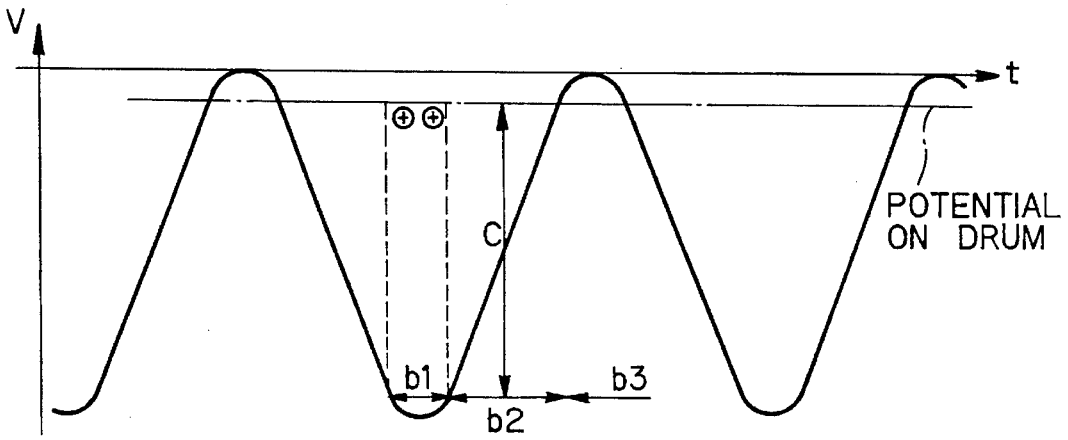
FIG. 2B is a graph similar to FIG. 2A, showing changes in the potential to occur when the electric field changes in a sinusoidal waveform.

A series of extended researches and experiments showed the following. When the voltage whose size sequentially changes in a rectangular wave form is used, the frequency, center value, amplitude and duty each has a certain adequate range which particularly promotes desirable cleaning. Also, the adequate ranges of the frequency, center value and amplitude are also adequate when use is made of an ordinary voltage having a sinusoidal waveform, as shown in FIG. 2B. These findings will be described specifically hereinafter.

Figure 3A:
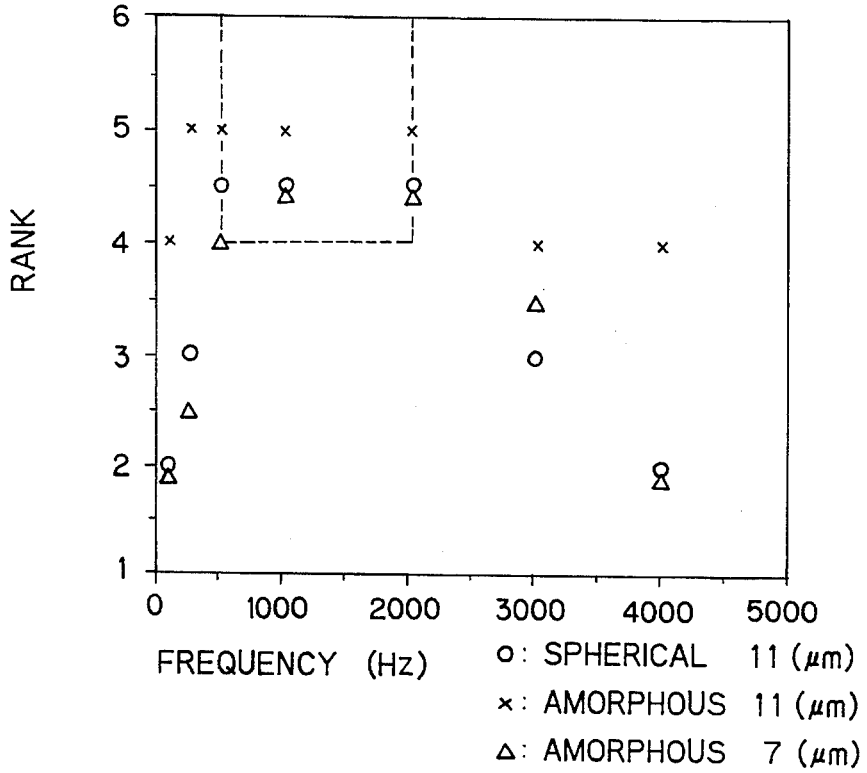
FIG. 3A is a graph showing a relation between the cleaning ability and the frequency of a voltage applied to the cleaning member.

FIG. 3A shows a relation between the frequency of the above voltage and the rank of cleaning ability, as determined by experiments. As to the cleaning ability, rank 5 is best while rank 1 is worst; ranks 4 and above are acceptable. For the experiments, the voltage had an amplitude of $1.3\times10^7$ V/m, center value of $3.3\times10^6$ V/m, and duty (on:off) of 1:1. As shown, with amorphous toner having a mean volume grain size of 11 μm, the rank is 4 or above when the frequency is 100 Hz to 4,000 Hz. However, with pulverized toner having a mean volume grain size of 7 μm and spherical toner having a mean volume grain size of 11 μm, the ranks 4 and above are not achieved unless the frequency lies in the range of from 500 Hz to 2,000 Hz, because such toners do not fly off the drum 1 easily due to their firm adhesion to the drum 1. Other experiments, conducted by changing the amplitude, center value and duty in various ways, also proved that the adequate range of the frequency is from 500 Hz to 2,000 Hz.

Figure 3B:
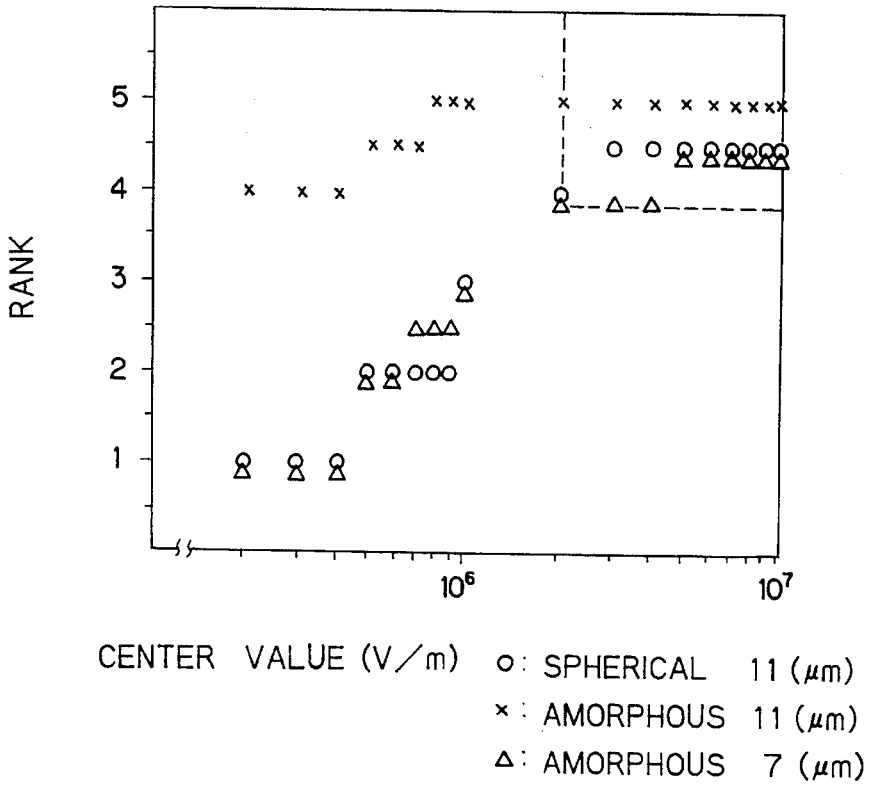
FIG. 3B is a graph showing a relation between the cleaning ability and the center value of the voltage.

FIG. 3B shows a relation between the center value of the voltage and the rank of cleaning ability, as also determined by experiments. For the experiments, the voltage had a frequency of 1 kHz, amplitude of $2.6\times10^6$ V/m, and duty (on:off) of 1:1. As shown, with the 11 μm amorphous toner, the rank is 4 or above when the center value is $1.0\times10^6$ V/m to $1.0\times10^7$ V/m. However, with the pulverized toner having a mean volume grain size of 7 μm and spherical toner having a mean volume grain size 11 μm, the ranks 4 and above are not achieved unless the center value lies in the range of from $2.0\times10^6$ V/m to $1.0\times10^7$ V/m, because such toners do not fly off the drum 1 easily due: to their firm adhesion to the drum 1. Center values greater than $8.0\times10^6$ V/m generate ozone due to leak. Hence, to achieve desirable cleaning while obviating ozone, the center value should preferably lie in the range of from $2.0\times10^6$ V/m to $8.0\times10^6$ V/m. Other experiments, conducted by changing the frequency, amplitude and duty ratio in various ways, also proved that the adequate range of the center value is from $2.0\times10^6$ V/m to $8.0\times10^6$ V/m.

Figure 3C:
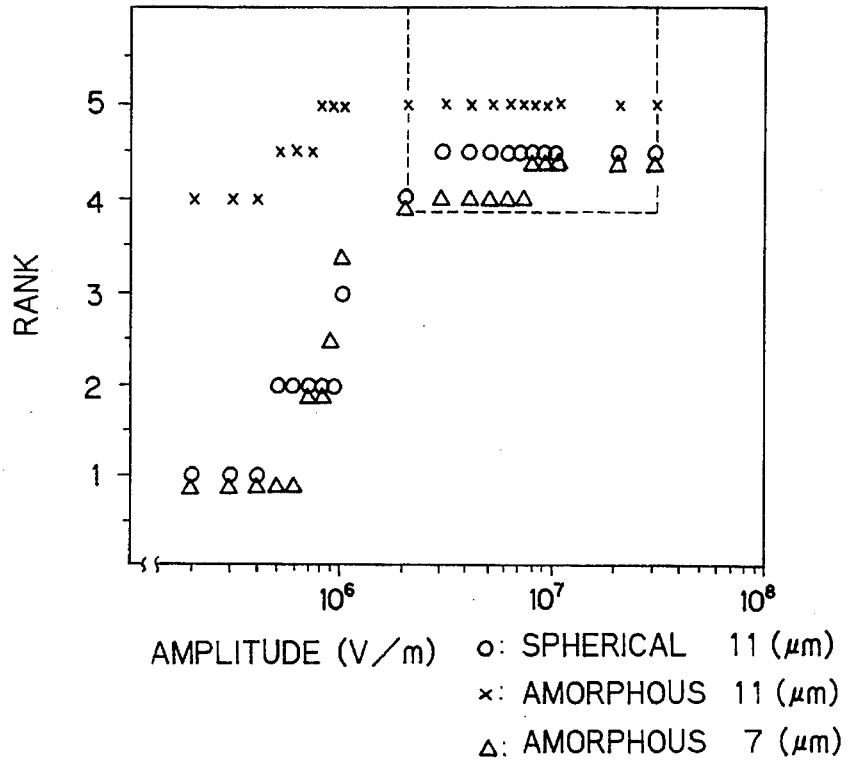
FIG. 3C is a graph showing a relation between the cleaning ability and the amplitude of the voltage.

FIG. 3C shows a relation between the amplitude of the voltage and the rank of cleaning ability. For the experiments, the voltage had a frequency of 1 kHz, center value of $2.0\times10^6$ V/m, and duty ratio (on:off) of 1:1. As shown, with the 11 μm amorphous toner, the rank is 4 or above when the amplitude is $2.0\times10^5$ V/m to $2.0\times10^7$ V/m. However, with the pulverized 7 μm toner and the spherical 11 μm toner, the ranks 4 and above are not achieved unless the amplitude lies in the range of from $2.0\times10^6$ V/m to $2.0\times10^7$ V/m, because such toners do not fly off the drum 1 easily due to their intense adhesion to the drum 1. Other experiments, conducted by changing the frequency, middle value and duty ratio in various ways, also proved that the adequate range of the amplitude is from $2.0\times10^6$ V/m to $2.0\times10^7$ V/m.

Figure 3D:
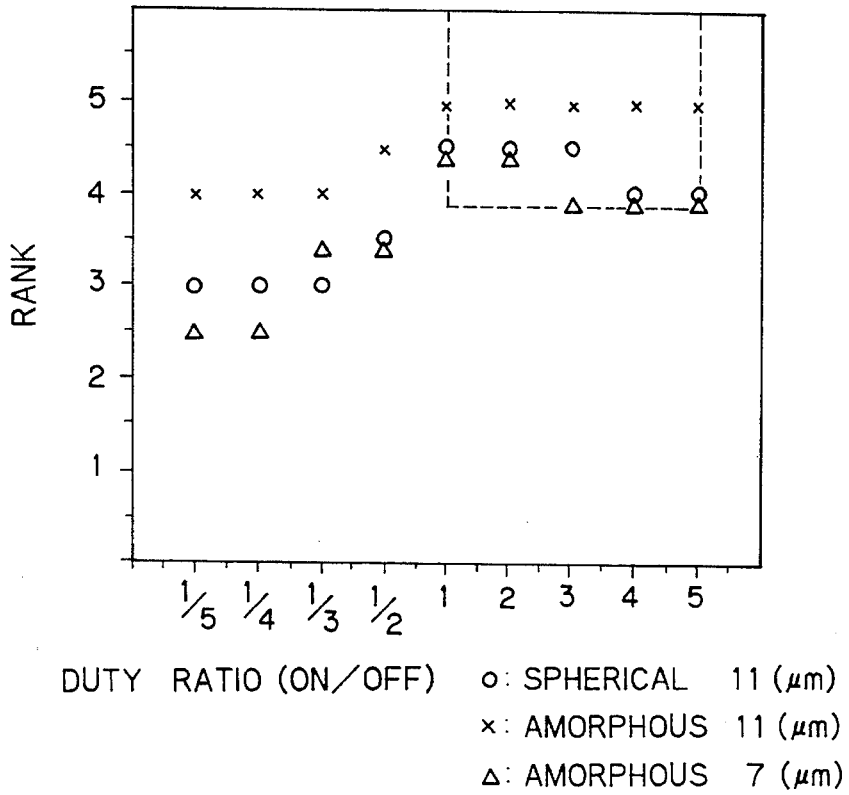
FIG. 3D is a graph showing a relation between the cleaning ability and the duty ratio of the voltage.

Further, FIG. 3D is representative of a relation between the duty ratio of the voltage and the rank of cleaning ability. For the experiments, the voltage had a frequency of 1 kHz, amplitude of $1.3\times10^7$ V/m, and middle value of $3.3\times10^6$ V/m. As shown, with the amorphous 11 μm toner, the rank is 4 or above: when the duty ratio is 1/5 to 5. However, with the pulverized 7 μm toner and the spherical 11 μm toner, the ranks 4 and above are not achieved unless the duty ratio lies in the range of from 1 to 5, because such toners do not fly off the drum 1 easily due to their intense adhesion to the drum 1. Other experiments, conducted by changing the frequency, amplitude and center value in various ways, also proved that the adequate range of the duty ratio is from 1 to 5.

As stated above, in the illustrative embodiment, a predetermined electric field is formed in the gap G between the roller 61 and the drum 1, so that the toner left on the drum 1 is collected by the roller 61 over the gap G. The gap G prevents the speed of the drum 1 from changing due to the friction between the drum 1 and the roller 61.

Figure 4A:
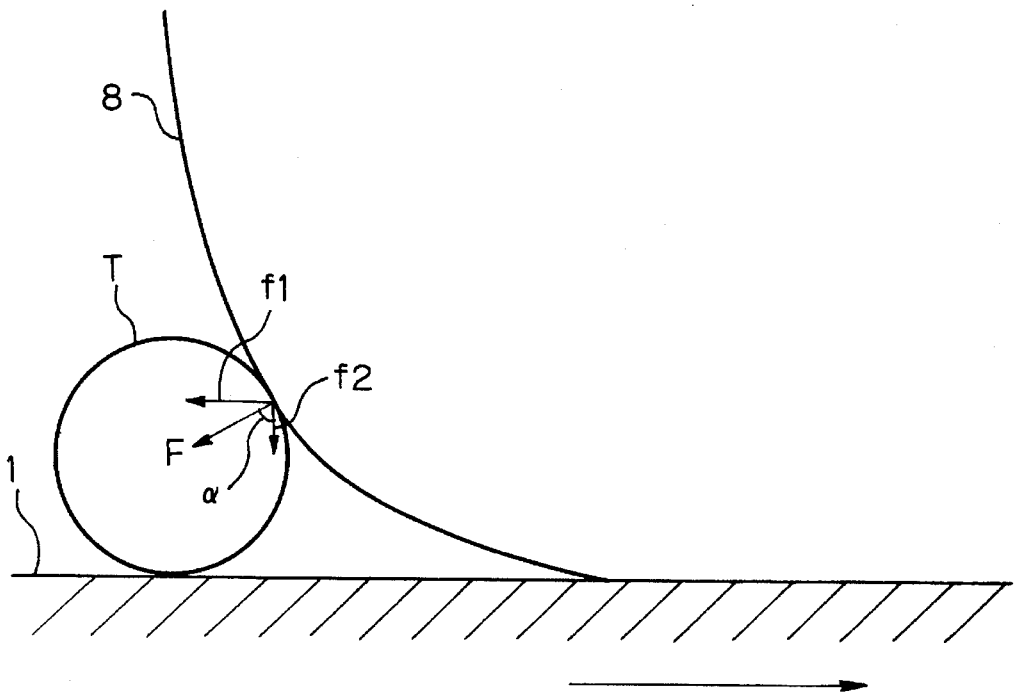
FIGS. 4A and 4B show the edge portion of a cleaning blade.
Figure 4B:
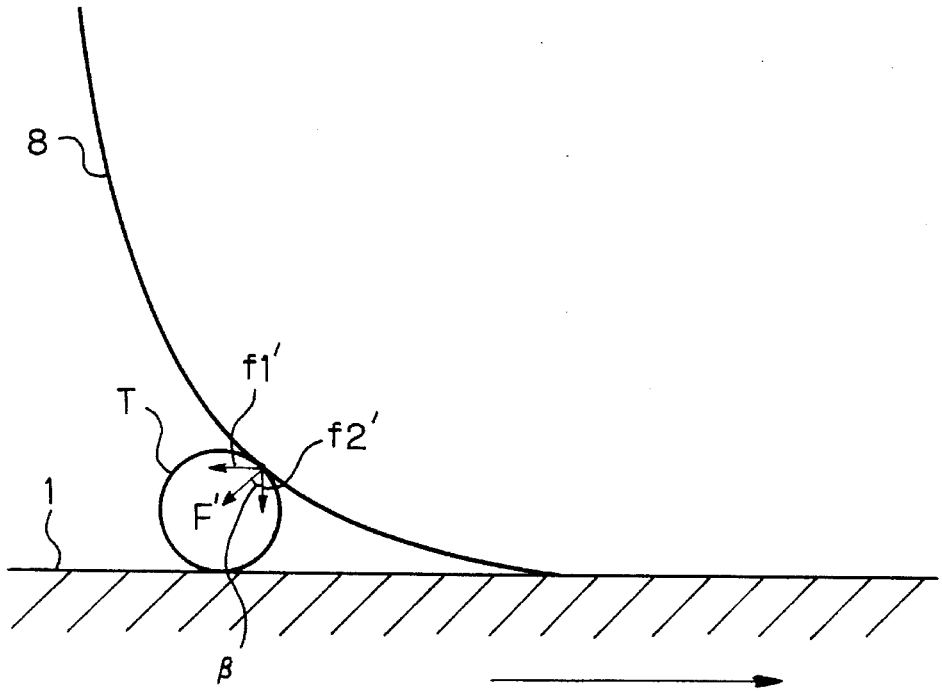

Why the cleaning unit 6 can surely collect even the spherical toner or the fine toner is as follows. First, the operation with the fine toner will be described. As shown in FIG. 4A, assume that the edge of the blade 8 contacts the drum 1 with a curvature in a microscopic view. When a toner particle T is brought into contact with the blade 8, a force F exerted by the blade 8 on the particle T is divided into a component $f_1$(=Fsin α) oriented in the direction of movement of the drum 1 and a component $f_2$(=Fcos α) oriented in the perpendicular direction. To clean the drum 1, it is necessary that a force $f_3$, not shown, for the drum 1 to convey the toner T be smaller than the component $f_1$($f_3<f_1$), and that the component $f_2$ be smaller than one which would raise the blade 8. However, as shown in FIG. 4B, the angle β between a force F' exerted by the blade 8 on the fine toner T and the vertical decreases from the angle α shown in FIG. 4A. As a result, a component $f_1$, FIG. 4B, of the force F' in the direction of movement of the drum 1 becomes smaller than the component $f_1$($f_1>f_1$), and a component $f'_2$ in the perpendicular direction becomes greater than the component $f_2$($f_2<f_2$). These changes are not desirable when it comes to cleaning. For example, assuming that the angle α of FIG. 4A and the angle β of FIG. 4B are respectively 60° and 30°, $f_1/f'_1=1.7$ and $f_2/f'_2=0.58$ are given.

On the other hand, the surface area of the toner for a given volume and, therefore, the amount of charge tends to increase with a decrease in grain size. For example, neglecting a loss due to a leak, halving the grain size doubles the surface area for a unit volume and also doubles the amount of charge. Hence, the embodiment, causing the roller 61 to collect the toner by the electric field, doubles the cleaning force. The embodiment is, therefore, particularly advantageous when combined with the fine toner.

The operation with the spherical toner is as follows. Generally, the adhesion acting between the toner and the drum 1 is derived from various kinds of forces including van der Waals' forces, Coulomb's force, and mirror image force. Usually, van der Waals' forces are predominant over the others, i.e., one figure to two figures greater than the others. Let the curvatures of the toner and drum 1 at their contact point be neglected for the simplicity of description. Specifically, assume that the toner and drum 1 make plane-to-plane contact. Then, van der Waals' forces Fv acting between the drum 1 and the toner are expressed as:

$$fv=E/8\pi(a+Zo)^9$$

where E denotes the surface energy of the drum 1 and toner, π denotes the ratio of the circumference of a circle to its diameter, α denotes the distance between the toner and the drum 1, and Zo denotes a constant (0.4 μm).

Figure 5A:
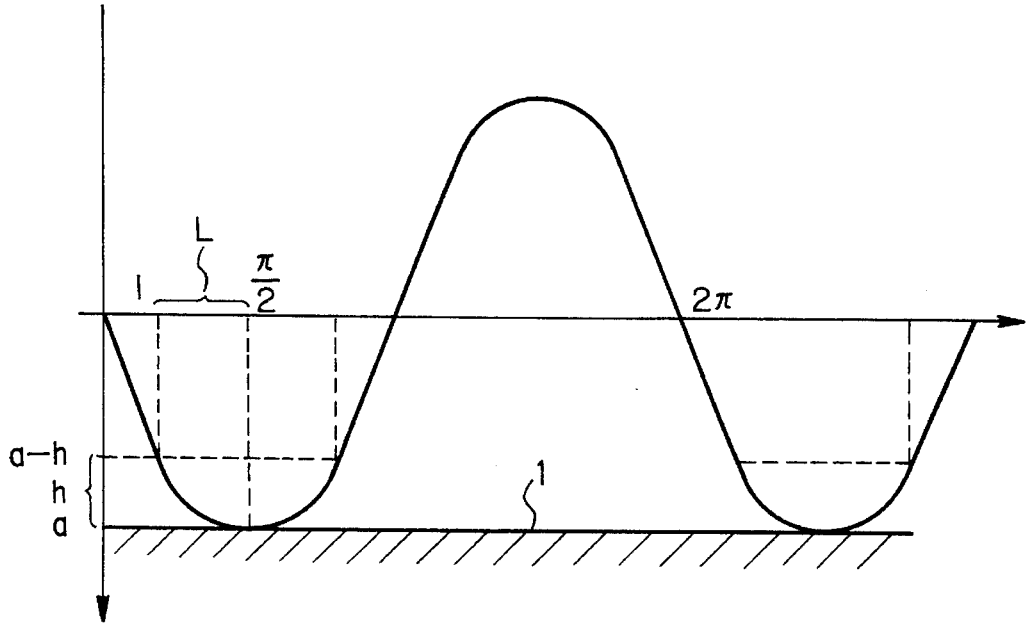
FIG. 5A shows the contact area of the surface of toner.

The difference between the spherical toner and the amorphous toner may be considered to be the difference in surface roughness. In this sense, let the surface of the toner be approximated to a sinusoidal curve shown in FIG. 5A, and let the range up the a height h (distance between the toner and the drum 1) be the range in which van der Waals' forces act (contact area). In this condition, a ratio in contact area will be estimated in terms of a ratio in van der Waals' forces due to the surface roughness.

First, assume that the curve representative of the surface of the toner is Y=α sin ωx where Y denotes the surface configuration, α denotes the amplitude or surface roughness, x denotes the position in the horizontal direction, and ω denotes the angular velocity which is equal to 2π/period. Because van der Waals' forces act up to the height h, the following equations hold:

$$a-h=a \sin \omega x$$

$$1-h/a=\sin \omega x$$

$$\omega x=\arcsin (1-h/a)$$

Assume that ω is 1 for the sake of simplicity of description. Then, because the period is 2π, $$x=\arcsin (1-h/a).$$

Assuming a ¼ period, the contact length is 1−π/2−x.

Figure 5B:
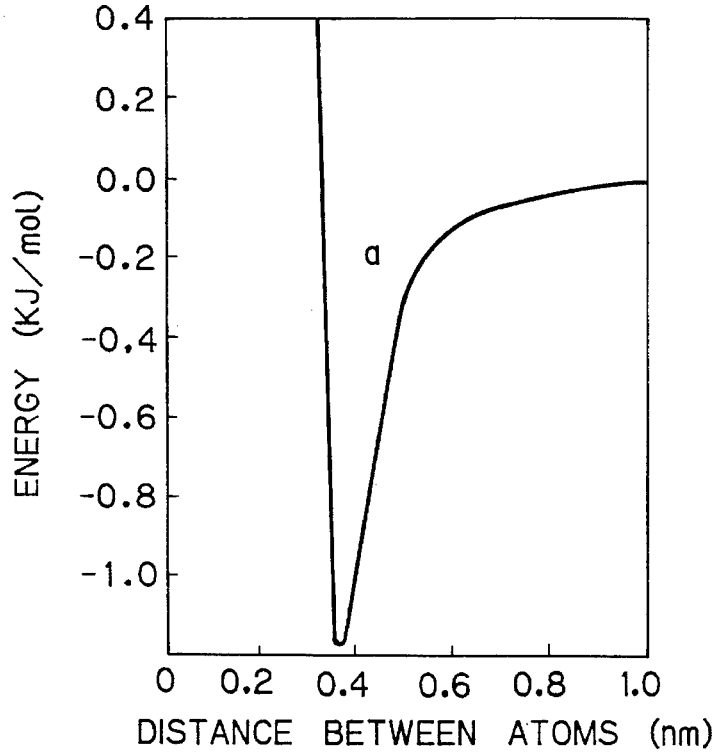
FIG. 5B shows a relation between the size of van der Waals' forces and the distance.

The spherical, toner has a surface roughness of bout 10 nm in terms of ten-point mean roughness while the amorphous toner has arc, roughness of about 1 μm, as determined by use of SEM (Scanning Electronic Microscope). Hence, assume that the ratio of the surface roughness of the spherical toner to that of the amorphous toner is 100 (the latter is 100 times as greater as the latter). Further, the height (distance from the drum 1) up to which van der Waals' forces act is about 1 nm (FIG. 5B; "Dictionary of Physics" published by Maruzen (Japan)). Specifically, the surface roughness of the spherical toner is ten times as great as the height h.

Assume that the surface roughness of the spherical toner and that of the amorphous toner are $a_1$=10h and $a_2$=1,000h, respectively. Then, by substituting $a_1$ and $a_2$ for α, the contact length $l_1$ of the spherical toner for the ¼ period of the sinusoidal curve is produced by:

$$\begin{aligned} l_1 &= \pi/2 - \arcsin (1 - h/10h) \\ &= \pi/2 - \arcsin (1 - 0.1) \\ &= 0.045 \end{aligned}$$

Likewise, for the ¼ period, the contact length $l_2$ of the amorphous toner is produced by:

$$\begin{aligned} l_1 &= \pi/2 - \arcsin (1 - h/1000h) \\ &= \pi/2 - \arcsin (1 - 0.001) \\ &= 0.045 \end{aligned}$$

The above estimation indicates that the contact length of the spherical toner is ten times as great as the contact length of the amorphous toner in the linear direction and is the square of the linear direction in area. As a result, the spherical toner is 100 times greater than the amorphous toner in terms of the ratio in contact area, i.e., adhering force. Actually, defective cleaning attributable to the configuration and determined by experiments has been reported (Journal of the Institute of Electgrophotographic Engineers of Japan, Vol. 32, No. 4 (1993)).

On the other hand, the illustrative embodiment is capable of releasing the toner seized by van der Waals' forces to the outside of the range (1 nm), in which the forces act, by using a predetermined electric field. When the predetermined electric field is implemented as an AC electric field, it is possible to apply oscillation (preferably resonance) to the toner and thereby release it to the outside of the above-mentioned range. As to the adhesion between the toner and the drum 1, because van der Waals' forces are one figure to two figures greater than the other forces, the spherical toner can be removed by being released from the above range.

When either the spherical toner or the toner whose mean volume grain size is less than 7 μm, the embodiment allows the duration of the electrostatic force greater than the adhesion of the toner to the drum 1 and acting on the toner to be increased in the case where the intensity of the alternating field changes in a rectangular waveform, compared to the case wherein it changes in a sinusoidal waveform. This is advantageous because the field which air between the drum 1 and the roller can hold is limited according to the Paschen's law, and because the degree to which the cleaning efficiency can be increased by increasing the amplitude or the center value of the alternating field is also limited. By switching the direction of the field more sharply, it is possible to induce fine oscillation to occur in the toner and thereby cause it to resonate. As a result, the toner is more easily released from the range of 1 nm in which van der Waals' forces act.

FIG. 2A shows changes in the potential of the roller to occur when the field intensity or strength changes in the rectangular waveform. FIG. 2B shows changes in the potential to occur when the field intensity changes in the sinusoidal fashion. Assume that negative-to-positive development is effected by use of negatively chargeable toner, that a toner image is transferred to a paper charged to the positive polarity by a charger, and that after the image transfer the drum 1 is illuminated over its entire surface before cleaning and controlled to a potential of 100 V thereby. Usually, the polarity of toner is positive, i.e., opposite to the initial polarity. Further, assume a case wherein a voltage having a frequency of 1 kHz, amplitude of 1,200 V and center value of 600 V and changing in size in the sinusoidal fashion with respect to tithe is applied to the roller spaced apart from the drum by a gap G of 150 μm, and a case wherein the voltage having the same frequency, amplitude and center value and a duty ratio of 1:1 and changing in the rectangular fashion is applied to the roller.

Let the potential differential between the roller and the drum, i.e., cleaning potential C be assumed to contribute to cleaning when higher than 1,000 V. Then, in the rectangular voltage shown in FIG. 2A, the duration of contribution $a_1$ is 0.6 msec. On the other hand, in the sinusoidal voltage shown in FIG. 2B, the duration of contribution $b_1$ is 0.2 msec which is one-third of the duration $a_1$. Hence, the rectangular voltage can give energy to the toner for a period of time three times longer than the period of time available with the sinusoidal voltage.

On the elapse of the cleaning time, the cleaning potential becomes 0 V in both of the waveforms shown in FIGS. 2A and 2B. As a result, among the toner particles flown off the drum, the particles not reached the roller are returned to the drum by the mirror image force acting between the roller and the base of the drum. At this instant, it is important to induce the resonance of the toner on the drum by selecting an adequate frequency matching the toner. The alternating field between the drum and the roller causes the intensely packed toner to resonate. As a result, the toner is loosened, moved out of the range where van del Waals' forces act, and then transferred to the roller.

On the other hand, in the sinusoidal voltage of FIG. 2B, the force propelling the toner is attenuated on the elapse of the period of time $b_1$ of 0.2 msec. The period of time $b_1$ is followed by a period of time $b_2$ of 0.4 msec for which no forces, in effect, act on the toner. The period of time $b_2$ is followed by a period of time $b_3$ of 0.2 msec for which the roller exerts a force in the direction for pulling the toner. The period of time $b_2$ obstruct the resonance of the toner and, therefore, the cleaning operation.

Figure 6:
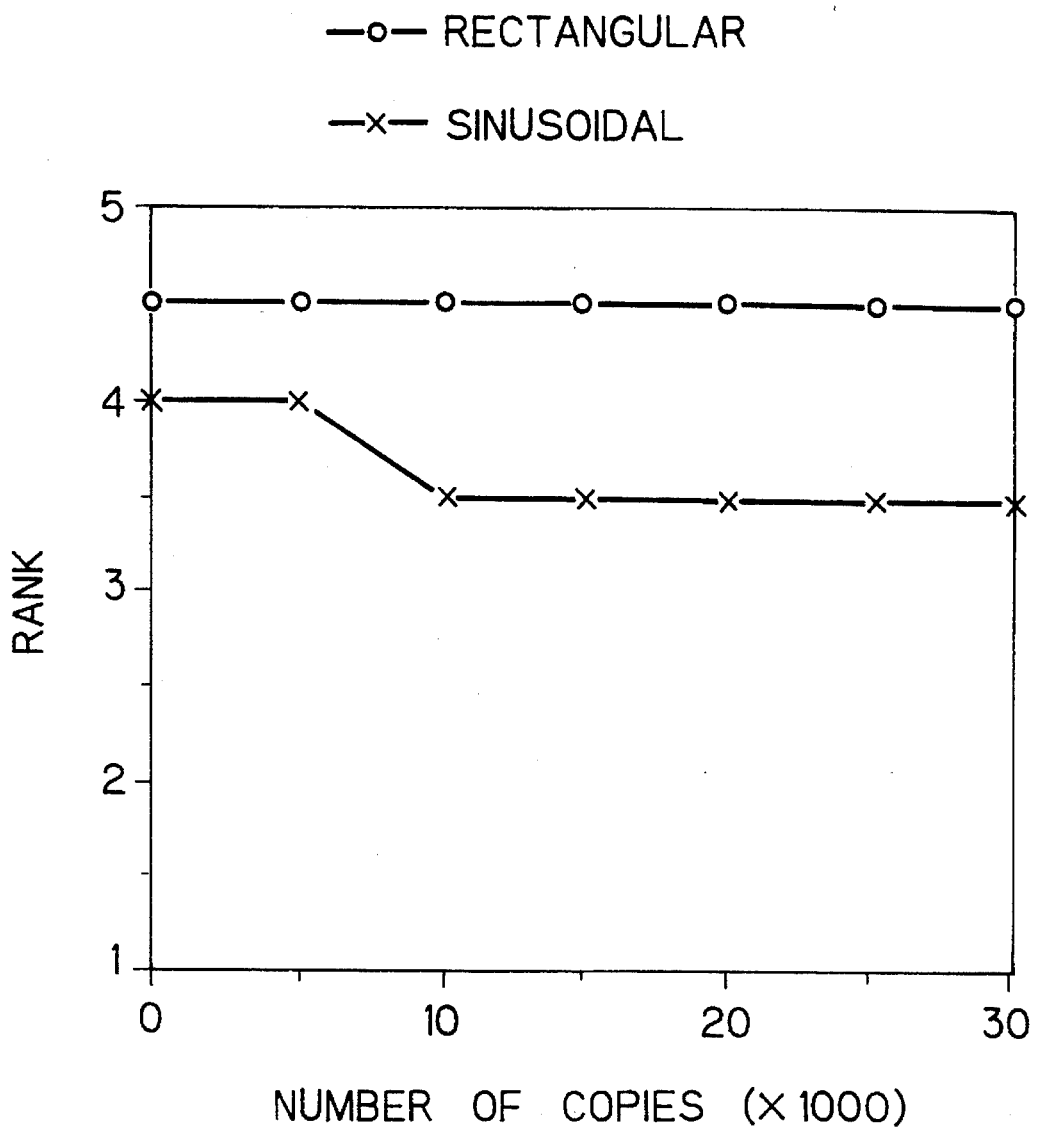
FIG. 6 is a graph comparing the cleaning ability available with the rectangular waveform and the cleaning ability available with the sinusoidal waveform.

FIG. 6 is a graph comparing the rectangular change in the potential of the roller and the sinusoidal change in the same with respect to the cleaning ability, as determined by experiments. Experiments were conducted under the same conditions as in FIGS. 2A and 2B. The cleaning ability is shown in five ranks 1–5; rank 5 is best while rank 1 is worst. As shown, both of the waveforms scarcely change the cleaning ability due to aging. However, the ability available with the rectangular wave belongs to ranks 4 and 5 which are higher than ranks 4–3.5 available with the sinusoidal wave.

It sometimes occurs that the cleaning potential C decreases due to an increase in the residual potential of the drum which is, in turn, attributable to the shaving of the photoconductor and optical fatigue. In the worst case, the decrease in potential C changes the substantial cleaning time b1 and substantial returning time b3 available with the sinusoidal voltage and reduces them to almost zero. By contrast, because the rectangular voltage has no inclinations, the substantial cleaning time $a_1$ or the substantial returning time $a_2$ changes little despite, for example, the increase in the residual potential. This is one of important points when it comes to marketability.

The amorphous toner is apt to have a broad charge distribution range because each particle is charged in a particular amount due to the difference in shape. By contrast, the particles of the spherical toner are identical in shape, and therefore the distribution of charges is confined in a relatively narrow range. This kind of toner is feasible for the embodiment, i.e., cleaning device relying on an electric field.

While the embodiment has concentrated on an image forming apparatus operable with a single component developer or toner, it achieves the above operation and advantages even with an apparatus using a two component developer or toner and carrier mixture, i.e., with a broad range of electrophotographic image forming systems. The roller may be rotated in the direction opposite to the direction shown and described. The embodiment is, of course, applicable to negative-to-positive development in the same way as to positive-to-positive development.

It is to be noted that the specific values shown and described are particular to the apparatus used and should be changed in matching relation to, for example, the characteristic of an apparatus applied.

In the embodiment, when use is made of a non-contact type developing device which, like the cleaning device, does not contact the drum, the fluctuation in the speed of the drum is small enough to ensure high image quality. This is contrastive to a developing device in which a developer carrier contacts the drum and rotates at a linear velocity different from that of the drum. An arrangement may be made such that while the roller faces the non-image area of the drum, an electric field causing the toner collected by the roller to move toward the drum is generated between the roller and the drum. This allows the toner collected by the roller to be returned to the non-image area of the drum, conveyed to the developing device by the drum, and then collected at the developing device, thereby facilitating the recycling of the waste toner.

As stated above, the illustrative embodiment has various unprecedented advantages, as enumerated below.

(1) A cleaning roller included in a cleaning device is spaced apart frown the surface of a photoconductive element. After image transfer, excess toner remaining on the photoconductive element is caused to fly toward the roller. Hence, the device is capable of surely collecting even the spherical toner or the fine toner which firmly adheres to the photoconductive element.

(2) The toner collected by the roller is removed by a blade, thereby initializing the roller.

(3) The gap between the roller and the photoconductive element can be easily maintained constant, compared to a gap between a cleaning member implemented as a belt and the photoconductive element. Hence, the electric field in the gap, which is of primary importance, can be maintained constant and ensures stable cleaning.

(4) Because the roller has a volume resistivity of smaller than $\times 10^3$ Ωcm, there can be reduced the charging of the roller surface due to the impingement of the toner and the rubbing of the blade. This prevents the cleaning ability from becoming unstable due to an unstable potential which would otherwise occur.

(5) An alternating field is formed between the roller and the photoconductive element to cause the toner to oscillate, thereby enhancing the cleaning efficiency.

(6) AC is superposed on the alternating field. This allows the device to cope even with a great amount of toner left on the photoconductive element.

(7) The roller, charging the photoconductive element, eliminates to need for an extra charger and thereby simplifies an image forming apparatus.

(8) The frequency, center value and amplitude of the alternating field are each selected in a particular range, further promoting desirable cleaning. Particularly, when the center value lies in a predetermined range, ozone due to leak can also be reduced.

(9) Because the intensity of the electric field changes in a rectangular waveform, the effective cleaning time is increased to implement efficient cleaning.

(10) The ratio of a duration of a field intensity having a great absolute value to a duration of a field intensity having a small absolute value ranges from 1 to 5. This further enhances desirable cleaning.

(11) The roller is provided with a particular surface roughness, and the blade contacts the roller. The surface roughness of the roller is smaller than the grain size of the toner and allows the roller to remove the toner in a desirable manner.

2nd Embodiment

In the first embodiment, the cleaning member is implemented as a single roller 6 1 and applied with a bias voltage alone. In this condition, it is likely that the cleaning member fails to sufficiently remove the toner left on the drum 1, depending on the adhesion between the drum 1 and the toner. In the embodiment to be described, a plurality of cleaning rollers are used to surely remove the remaining toner from the drum 1. In addition, a bias voltage of particular polarity is applied to each cleaning roller in order to enhance the efficient removal of the toner.

Figure 7:
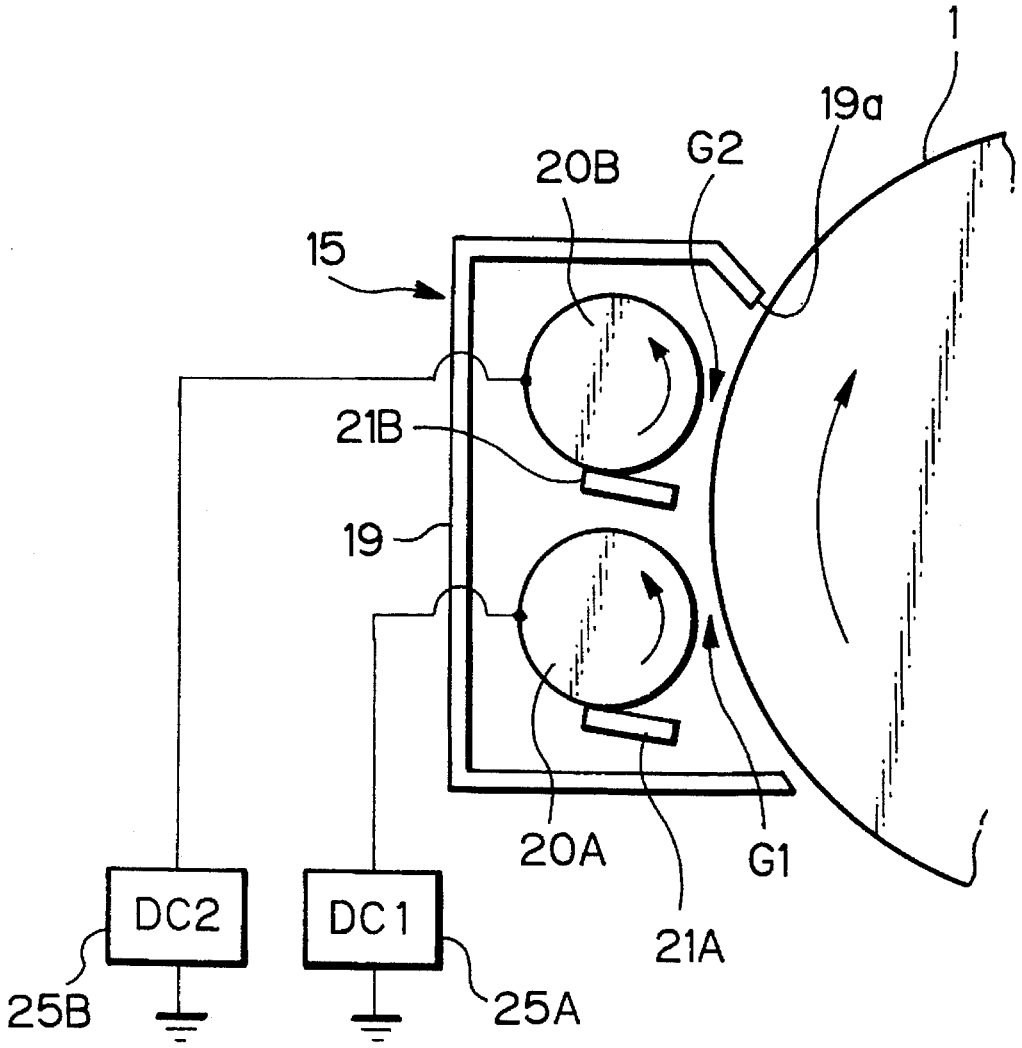
FIG. 7 is a section showing a second embodiment of the present invention.

Specifically, as shown in FIG. 7, a cleaning device 15 has a box-like casing 19 elongate in the axial direction of the drum 1. Cleaning members in the form of parallel rollers 20A and 20B are disposed in the casing 19 and spaced apart in the direction in which the drum 1 rotates. The casing 19 is formed with an elongate slot 19*a* such that the rollers 20A and 20B face the drum 1 via the slot 19*a*. The rollers 20A and 20B are respectively spaced apart from the drum 1 by gaps G1 and G2 (e.g. G1=G2=105 μm) and rotatable independently of each other. Flat elongate blades 21A and 21B are fixed in place in the casing 19 and respectively pressed against the rollers 20A and 20B at their one edge. Bias sources 25A and 25B are electrically connected to the rollers 20A and 20B, respectively. The bias sources 25A and 25B each outputs a DC bias voltage of particular polarity.

In operation, to clean the drum 1 after the image transfer, the rollers 20A and 20B are rotated by a motor, not shown, in the same direction, as indicated by arrows in the figure. At the same time, DC bias voltages VDC1 and VDC2 different in polarity from each other are applied from the bias sources 25A and 25B to the rollers 20A and 20B, respectively. As a result, a potential difference of, for example, negative polarity (e.g. −500 V to −1,500 V) is produced between the roller 20A and the drum 1. Likewise, a potential difference of positive polarity (e.g. +500 V to +1,500 V) is produced between the roller 20B and the drum 1. In this condition, the toner of positive polarity and the toner of negative polarity left on the drum 1 are electrostatically transferred from the drum 1 to the rollers 20A and 20B, respectively. Then, the blades 21A and 21B respectively remove the toner from the rollers 20A and 20B mechanically. Hence, the rollers 20A and 20B, constantly facing the drum 1 at their cleaned surfaces, attract the toner electrostatically.

The gaps G1 and G2 should only be selected in matching relation to the characteristic of the image forming apparatus applied and, in addition, do not have to be equal to each other. Of course, the polarities of the bias voltages applied to the rollers 20A and 20B may be replaced with each other. The voltages are also selected in matching relation to the characteristic of the apparatus as well as to the characteristic of the toner applied.

Figure 8:
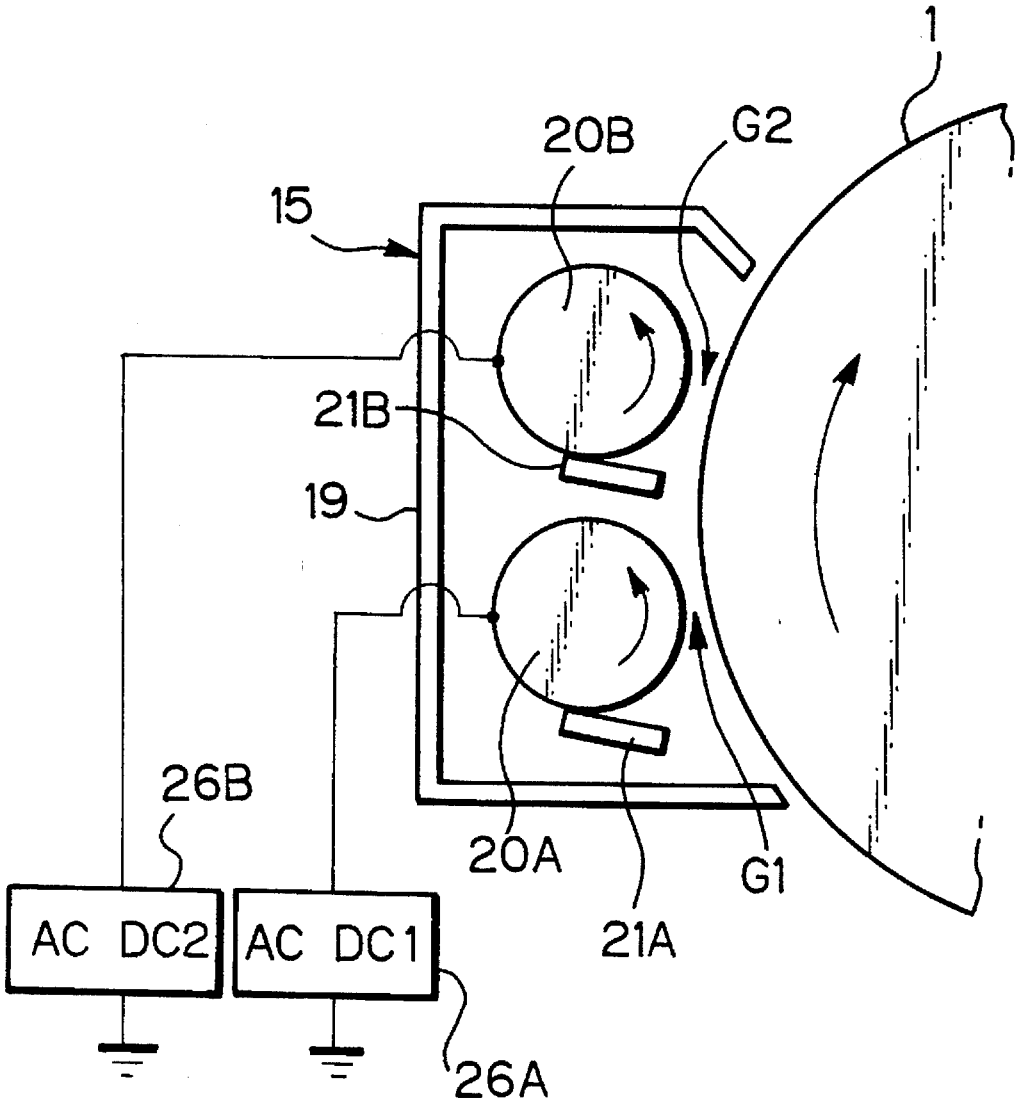
FIG. 8 is a section showing a modification of the second embodiment.

In the illustrative embodiment, the DC bias voltages are applied to the rollers 20A and 20B. Alternatively, as shown in FIG. 8, bias sources 26A and 26B, each outputting an AC-biased DC bias voltage of particular polarity, may be connected to the rollers 20A and 20B, respectively. Specifically, the bias sources 26A and 26B outputs voltages VAC.DC1 and VAC.DC2 of different polarities, respectively. The voltages VAC.DC1 and VAC.DC2 may each have a DC component which is equal to the center value of an AC component. The frequency of the AC component is selected to be 100 Hz to 3,000 Hz. When only a DC bias voltage is applied to each of the rollers 20A and 20B, it is likely that the roller fails to remove the entire toner from the drum 1 due to, for example, the image forming conditions and the characteristic of the toner. By contrast, the AC-biased DC voltages allow the rollers 20A and 20B to attract the toner more effectively and, therefore, to remove substantially the entire toner from the drum 1. The voltages and the order of polarities of each AC-biased DC voltage are also selected on the basis of the characteristic of the toner and that of the image forming apparatus.

Figure 9:
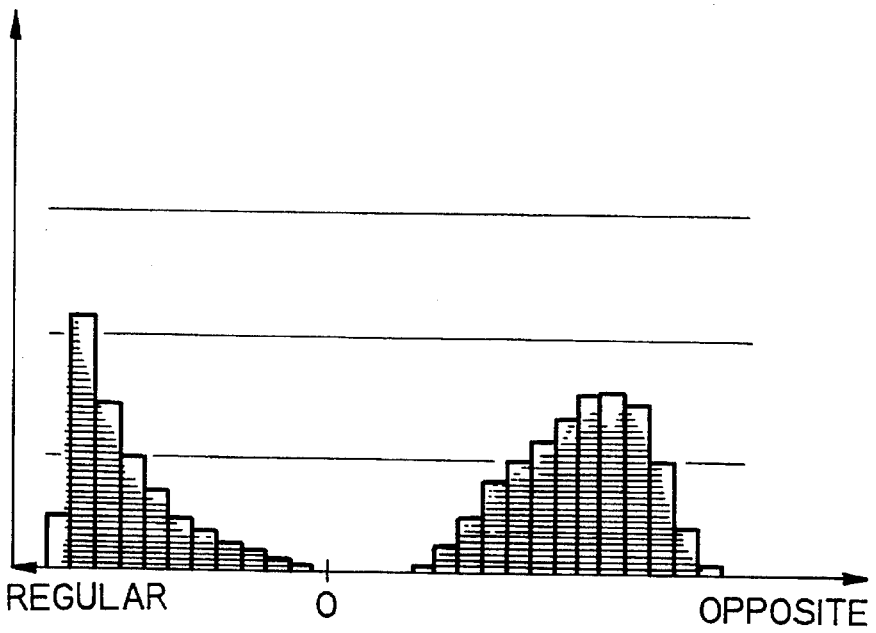
FIG. 9 is a graph showing a specific charge distribution of toner remaining on a photoconductive element after image transfer.
Figure 10:
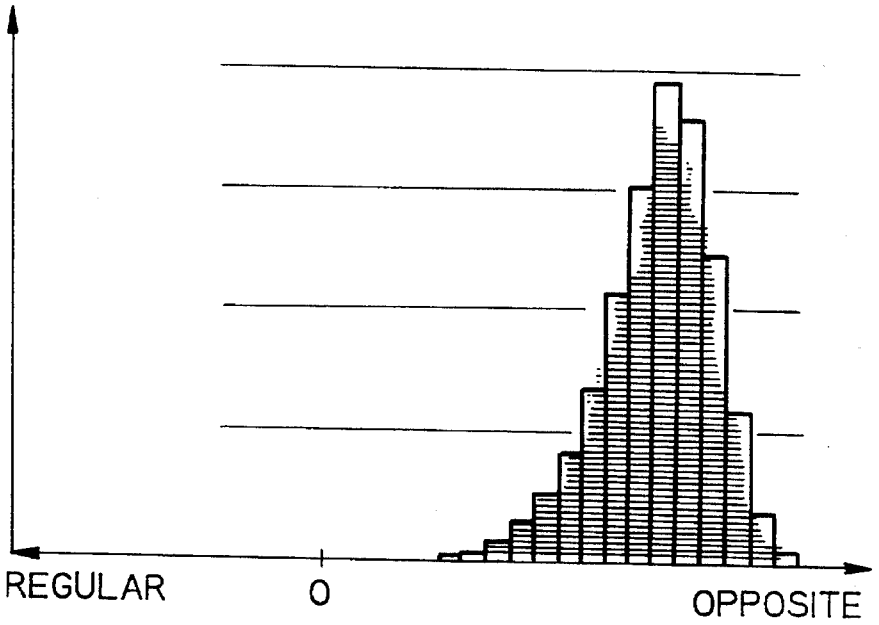
FIG. 10 is a graph showing another specific charge distribution.

The charge distribution of the toner after the image transfer is not always the same due to the characteristic of the toner and that of the image forming apparatus. Experiments showed that when the combination of certain toner and certain image forming apparatus (combination A) is used to form an image, the toner left on the drum 1 after the image transfer has a charge distribution shown in FIG. 9. When use was made of the combination of another toner and another image forming; apparatus (combination B), the residual toner on the drum 1 had a charge distribution shown in FIG. 10. In FIG. 9, the toner resulted from the combination A consists of positively charged toner and negatively charged toner. In FIG. 10, the toner resulted from the combination B has only negatively charged toner.

Therefore, the toner having opposite polarities, as shown in FIG. 9, can be removed if bias voltages of opposite polarities are respectively applied to the two rollers 20A and 20B. For the toner of a single polarity shown in FIG. 10, a single cleaning roller will suffice. However, when the transfer efficiency, for example, of the toner image to a paper is lowered, it is likely that the amount of toner to remain on the drum 1 is too great to be removed by a single roller. In light of this, bias voltages of the same polarity, i.e., the polarity opposite to that of the toner should preferably be applied to both of the rollers 20A and 20B. This is also desirable when a paper jams the transport path. Again, the voltages of the same polarity may be selected in matching relation to the characteristic of the toner and that of the image forming apparatus. However, it is not necessary for the voltages applied to the rollers 20A and 20B to be of the same value.

Figure 11:
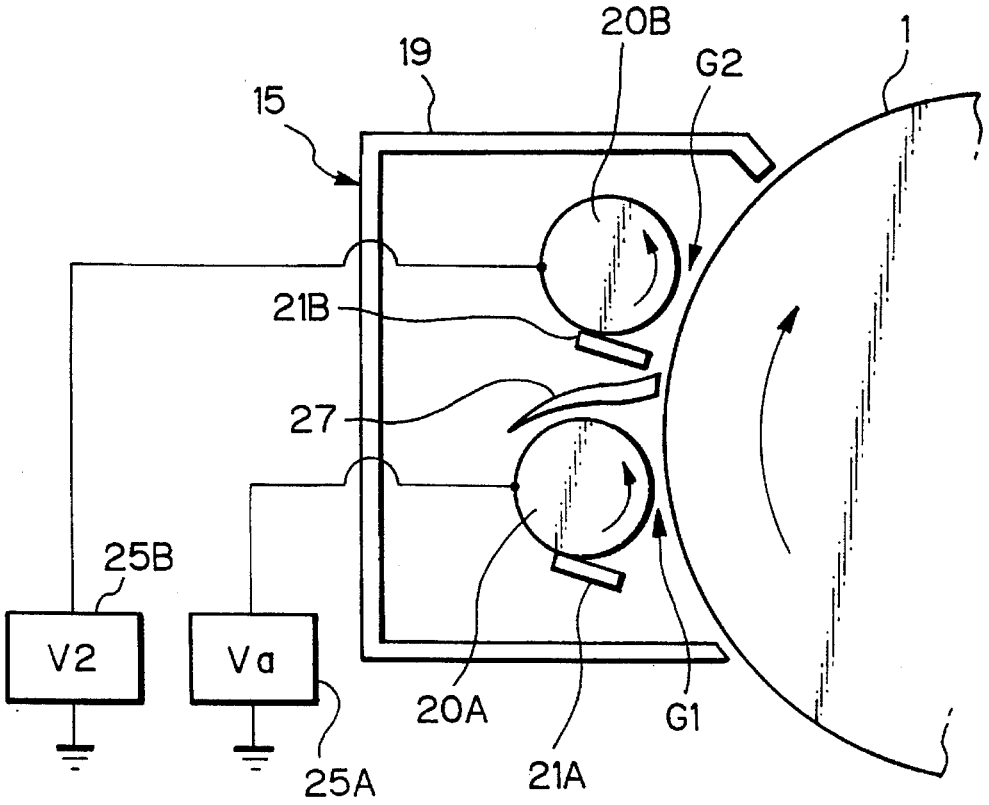
FIGS. 11–15 are sections each showing another modification of the second embodiment.

Assume that the toner collected by the roller 20A approaches the other roller 20B, opposite in polarity to the roller 20A, before it is removed from the roller 20A. Then, it is likely that the toner is transferred from the roller 20A to the roller 20B and then to the drum 1. FIG. 11 shows a modification of the embodiment and capable of eliminating the above problem. As shown, a screen 27 is interposed between the rollers 20A and 20B. The screen 27 prevents the toner deposited on the roller 20A from being attracted by the roller 20B and prevents the toner deposited on the roller 20B from being attracted by the roller 20A. The toner is, therefore, prevented from being returned to the drum 1.

Figure 12:
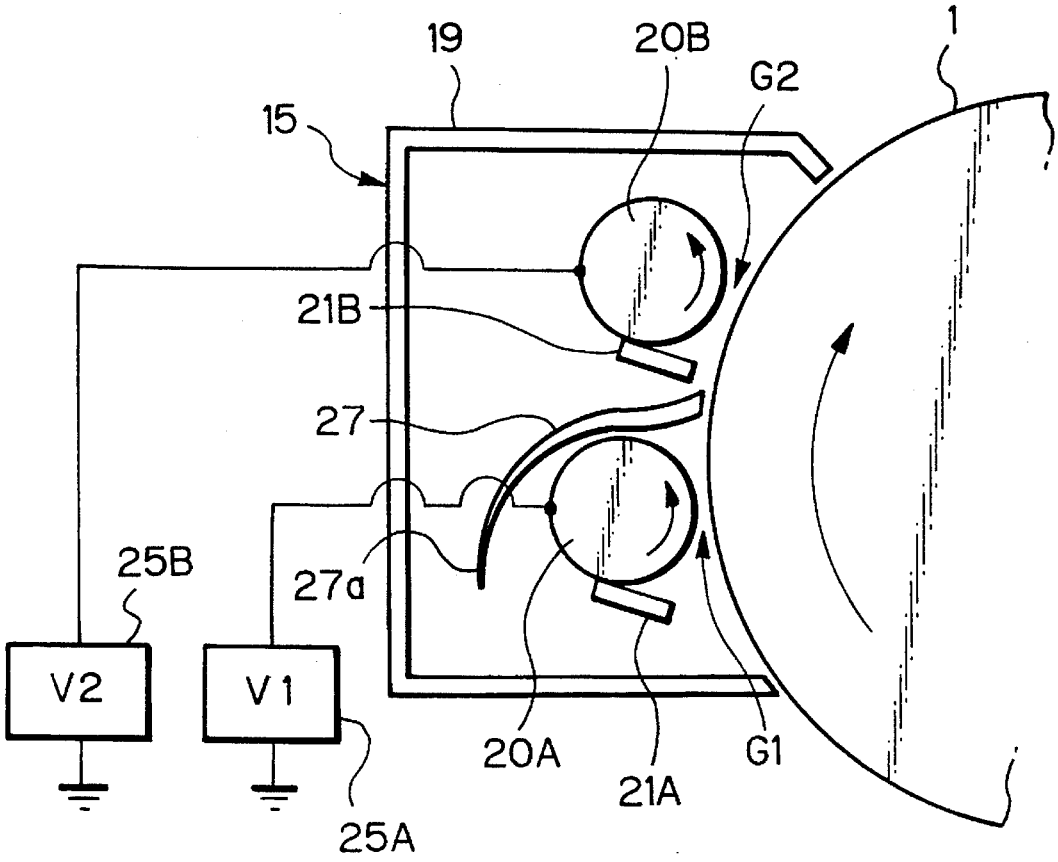

FIG. 12 shows another specific configuration of the screen 27. As shown, one edge 27*a* is of the screen 27 is extended downward while being curved along the periphery of the roller 20A. Even when the toner collected by the roller 20B is scraped off, the screen 27 with the above configuration prevents it from depositing on the roller 20A. This advantage is also achievable when the cleaning members are not implemented as rollers, only if the screen 27 is provided with a shape complementary to the shape of the cleaning members. In addition, the screen 27 may be provided with a shape matching the entire cleaning device 15 to further enhance the effect thereof.

However, the toner adhered to the screen 27 is apt to lower the cleaning ability and to damage the drum 1 due to dielectric breakdown between it and the drum 1. When the screen 27 was made of a dielectric material having a volume resistivity higher than $10^7$ Ωcm, the dielectric breakdown did not occur even when the screen 27 and drum 1 were brought closer to each other due to, for example, jitter in the direction of rotation of the drum 1. The screen 27, therefore, contributed a great deal to the production of attractive images over a long period of time.

The screen 27, however, gave rise to a problem that the toner deposited on the rollers 20A and 20B is apt to fly about, depending on the characteristic of the toner and that of the image forming apparatus. This problem was obviated when the screen 27 was made of a conductor in order to generate an electric field between it and the rollers 20A and 20B. However, if the gap between the screen 27 and the drum 1 is small, dielectric breakdown occurs between them and damages the drum 1. When the gap was selected to be 1 mm, the dielectric breakdown did not occur despite the jitter in the rotation of the drum 1. It should be noted that the gap of 1 mm is particular to the apparatus used for experiments and will be changed on the basis of, for example, the material of the screen 27 and that of the drum 1.

Figure 13:
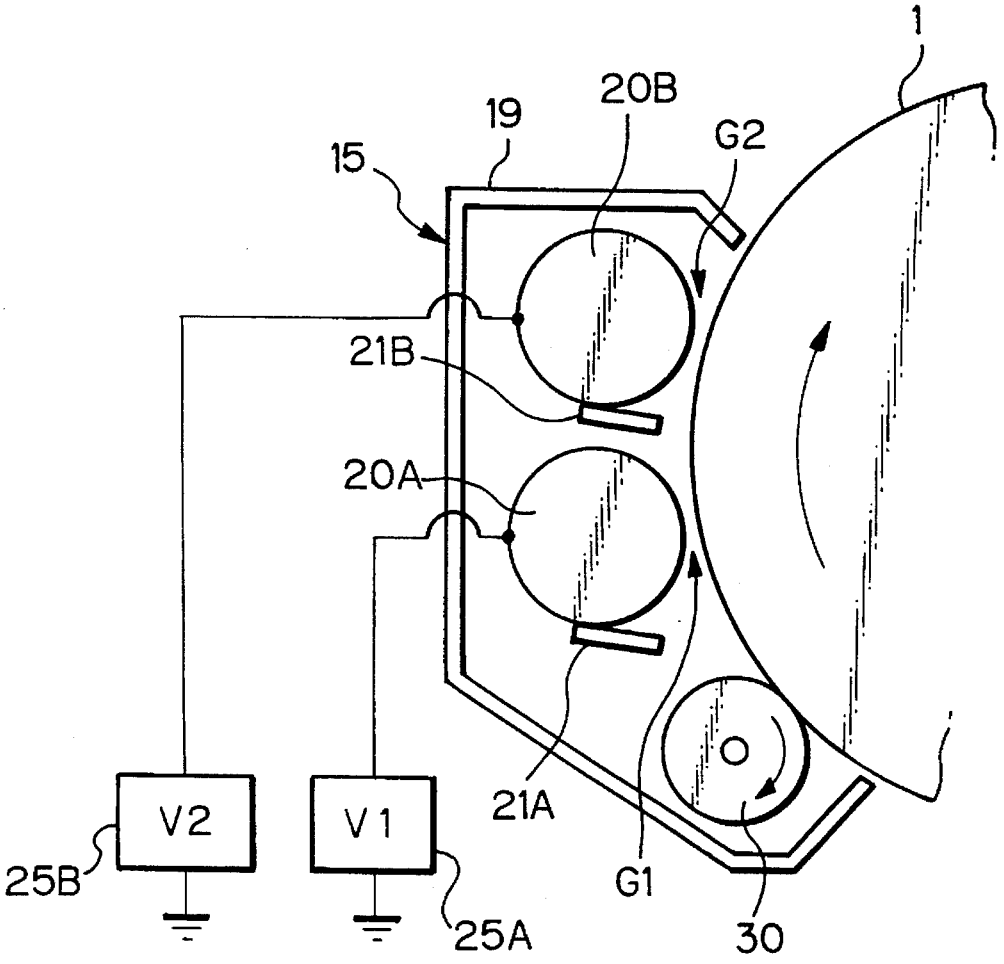

Another modification of the embodiment is shown in FIG. 13. As shown, a fur brush 30 is additionally disposed in the casing 19 upstream of the roller 20A in the direction of rotation of the drum 1; that is, it is closer to the image transfer position than to the cleaning position of the roller 20A. The fur brush 30 is rotatable in contact with the drum 1. The fur brush 30 is used not to collect the toner from the drum 1, but to reduce the electric and dynamic coupling between the toner and the drum 1. This facilitates the electrostatic deposition of the toner on the rollers 20A and 20B which follow the fur brush 30. For this purpose, the fur brush 30 lightly contacts the drum 1 and has a diameter of about 10 mm to 30 mm.

Figure 14:
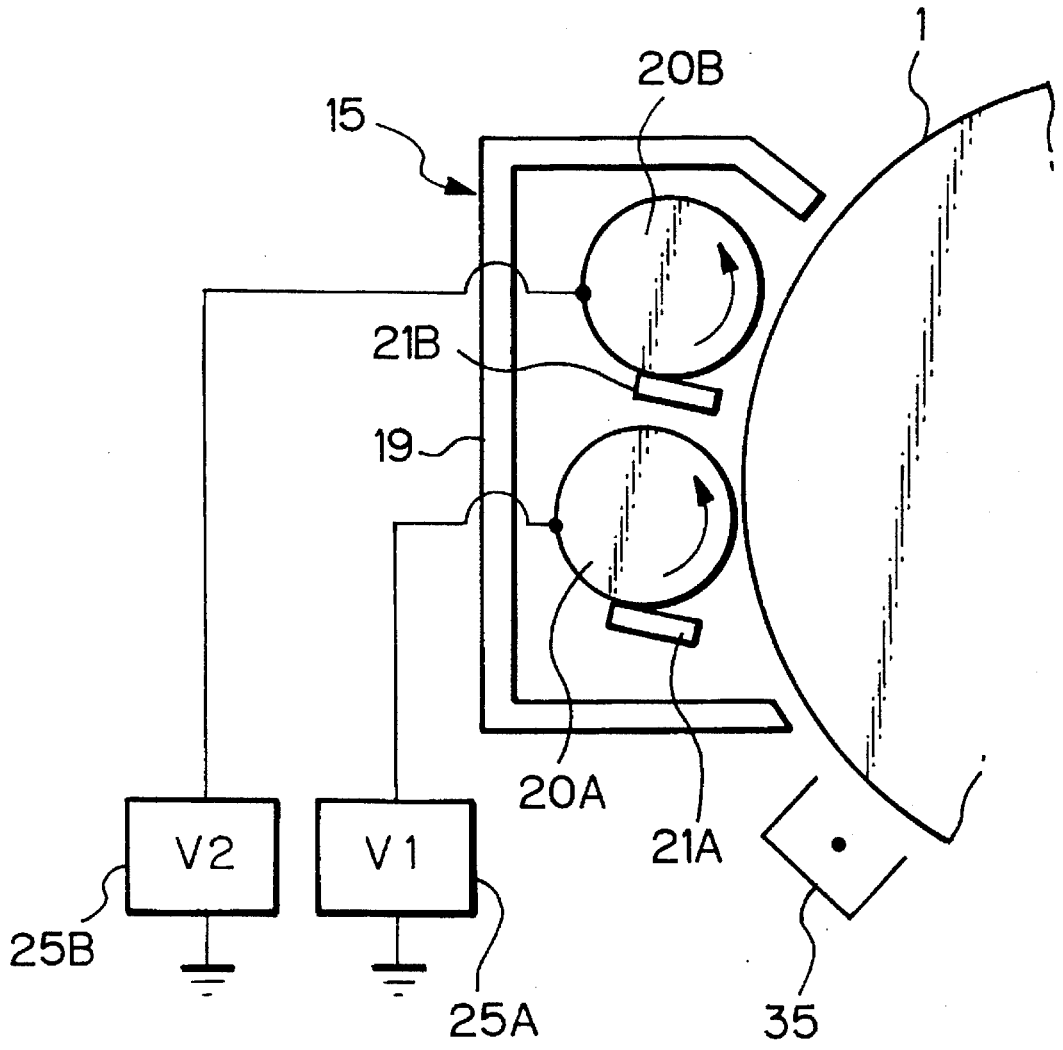

If desired, a discharger may be used to reduce the electrostatic adhesion of the toner to the drum, rather than the mechanical deposition of the same. Specifically, as shown in FIG. 14, a precleaning charger 35 is located at the cleaning position and close to the image transfer position and faces the drum 1. The charger 35 applies a negative voltage to the drum 1 and thereby reduces the amount of charge deposited thereon. This successfully weakens the electrostatic adhesion of the toner to the drum 1 and promotes the separation of the toner.

Figure 15:
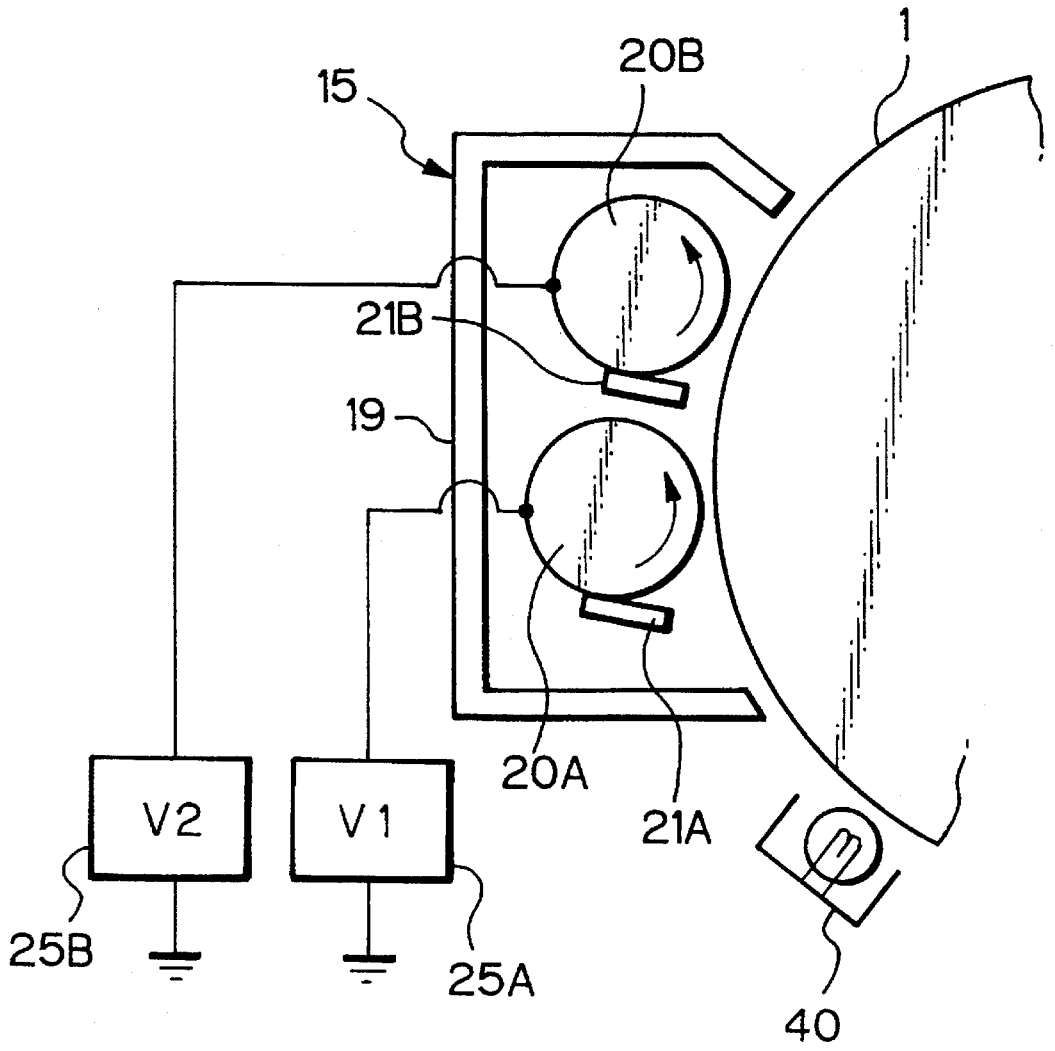

As shown in FIG. 15, a discharge lamp 40 may be substituted for the precleaning charger 35 and located at the same position as the charger 35. The lamp 40 illuminates the surface of the drum 1 to thereby reduce, the amount of charge deposited thereon. The lamp 40 is comparable with the charger 35 in respect of the advantage.

Further, the fur brush 30 and the discharge lamp 40 or similar discharger may tie used in combination in order to reduce both of the mechanical and electrostatic adhesion of the toner to the drum 1. The precleaning charger 35 and discharge lamp 40 may be combined, if desired.

In this embodiment and modifications thereof, the rollers 20A and 20B are rotated by a motor. It is preferable that the linear velocity of the rollers 20A and 20B be higher than that of the drum 1 for the following reason. In this condition, the area of movement of the rollers 20A and 20B is increased for the unit area of the drum 1, so that a greater amount of toner can be deposited on and collected by the rollers 20A and 20B. It was found that a desirable toner collection ratio is achievable when the linear velocity of the rollers 20A and 20B is 1.3 times to three times as high as the linear velocity of the drum 1. However, this is only illustrative and may also be selected in matching relation to the characteristic of the toner and that of the image forming apparatus. It is not necessary to drive the two rollers 20A and 20B at the same linear velocity.

As stated above, the embodiment applies bias voltages to the rollers 20A and 20B and thereby causes them to attract the toner on the drum 1 without contacting the drum 1. Hence, even the fine spherical toner or the toner produced by polymerization can be successfully removed from the drum 1. Specifically, spherical toners in general have grain sizes smaller than 10 μm and, of course, have a substantially spherical shape which is not easy to catch. A conventional cleaning unit of the type having a blade contacting a photoconductive element and using the spherical toner cannot achieve a high cleaning efficiency due to undesirable conditions combined together. The embodiment is free from this problem because the rollers 20A and 20B do not contact the drum 1. The embodiment was found to remove even the spherical toner pulverized and heated and having a mean grain size of 8 μm or less. When use is made of the spherical toner having a mean grain size of less than 10 μm, the embodiment ensures both the efficient cleaning and the high image quality.

On the other hand, fine toners generally have grain sizes smaller than 7 μm. Hence, in the conventional cleaning unit of the type having a blade contacting a photoconductive element, the fine toner passes through between the surface of the photoconductive element and the blade, lowering the cleaning ability of the unit. The embodiment does not have this drawback and is operable even with fine toner whose mean grain size is smaller than 7 μm. When use was made of fine toner having a mean grain size of 4 μm, the embodiment exhibited a desirable cleaning ability.

Further, toners produced by polymerization have grain sizes smaller than 10 μm and have a spherical shape which is not easy to catch. Hence, the conventional cleaning unit of the type having a blade contacting a photoconductive element cannot achieve a high cleaning efficiency for the same reasons as described in relation to the spherical toner. The embodiment is free front this problem and can remove even the polymerized toner having a mean grain size of less than 10 μm. When use was made of polymerized toner taught in Japanese Patent Laid-Open Publication No. 4-137372, the embodiment removed it satisfactorily.

The embodiment is also operable with toner containing a lubricant. The lubricant may advantageously be, for example, 0.5 wt % of zinc stearate powder (mean grain size of 1 μm) or similar substance having a small coefficient of friction. Alternatively, the lubricant may be implemented by 0.5 wt % to 1.0 wt % of silica (mean grain size of 0.1 μm), 0.5 wt % to 1.0 wt % of alumina (mean grain size of 0.5 μm), or fatty acid metal salt. Further, the lubricant may be directly applied to the surface of the drum 10. When the lubricant is contained in or applied to the outer periphery of the toner or is directly applied to the drum 1, it promotes the separation of the toner from the surface of the drum 1. This facilitates the electrostatic transfer of the toner from the drum 1 to the rollers 20A and 20B and thereby enhances the cleaning ability. However, the toner with the lubricant sequentially reduces the coefficient of friction of the drum surface due to repeated development. In addition, when the lubricant is applied to the drum 1, it positively reduces the coefficient of friction of the drum surface, causing the toner itself to slip easily.

In light of the above, use may be made of a non-contact type developing system using a nonmagnetic toner, as distinguished from a toner and carrier mixture, as taught in Japanese patent Laid-Open Publication No. 4-127177. Then both the desirable cleaning ability and the high quality development are achievable. The system taught in this document constitutes an improvement over the traditional system in which toner is deposited on a developing roller in a single layer, and the roller is rotated at a linear velocity two times to four times as high as that of an image carrier. Specifically, the system deposits toner on a developing roller in a plurality of layers and drives the roller at substantially the same linear velocity as an image carrier, thereby ensuring an even solid image and high-speed operation. When the image carrier was implemented by OPC (Organic Photo Conductor), when the latent image potential was −50 V to −150 V, and when the bias voltage was implemented as pulses having a voltage of 0 V to 1,000 V and a frequency of 1.5 kHz to 2.0 kHz, attractive images were produced. It follows that the lubricant, combined with the non-contact developing system, realizes a high quality image forming apparatus which matches the cleaning characteristic and developing characteristic to each other.

While the embodiment has concentrated on an image forming apparatus operable with a single component developer or toner, it achieves the above operation and advantages even with an apparatus using a two component developer or toner and carrier mixture, i.e., with a broad range of electrophotographic image forming systems. The rollers 20A and 20B may be rotated in the direction opposite to the direction shown and described. Three or more cleaning rollers may be used, if desired. The embodiment is, of course, applicable to positive-to-positive development in the same way as to negative-to-positive development.

The advantages of the illustrative embodiment are summarized hereinafter.

(1) A plurality of cleaning rollers electrostatically remove toner from a photoconductive element without contacting the element. This ensures the removal of the toner from the element. Because a bias voltage of particular polarity is applied to each of the cleaning rollers, even particles of the same polarity as one of the bias voltages and included in the toner can be removed.

(2) A screen is interposed between the cleaning rollers and prevents the toner removed from the element from being returned to the element by way of the cleaning rollers.

(3) The screen is made of a material which does not cause dielectric breakdown to occur. As a result, the element and the entire image forming apparatus are free from damage attributable to dielectric breakdown.

(4) When the screen is made of a conductor and spaced apart from the element by a distance which does not cause dielectric breakdown to occur, the dielectric breakdown can be easily obviated.

Various modifications will become possible for those skilled in the art after receiving the teachings of the present disclosure without departing from the scope thereof.

What is claimed is:

1. A cleaning device for an image forming apparatus and for removing toner left on an image carrier after a toner image has been transferred from said image carrier to a transfer medium, said device comprising:

a plurality of cleaning members spaced apart from a surface of the image carrier by a predetermined gap; and bias applying means for applying a bias voltage of particular polarity to each of said plurality of cleaning members.

2. A device as claimed in claim 1, further comprising a screen member intervening between said plurality of cleaning members.

3. A device as claimed in claim 2, wherein said screen member is made of a dielectric material having a volume resistivity of $10^7$ Ωcm or above.

4. A device as claimed in claim 2, wherein said screen member is made of a dielectric material and spaced apart from the surface of the image carrier by a distance which does not cause dielectric breakdown to occur.

5. A cleaning device for an image forming apparatus and for removing toner left on an image carrier after a toner image has been transferred from said image carrier to a transfer medium, said device comprising:

cleaning means spaced apart from a surface of the image carrier by a predetermined gap;

electric field forming means for forming between said cleaning means and the image carrier an electric field for causing the toner to fly from said image carrier toward said cleaning means; and said toner comprising spherical toner.

6. A cleaning device for an image forming apparatus and for removing toner left on an image carrier after a toner image has been transferred from said image carrier to a transfer medium, said device comprising:

cleaning means spaced apart from a surface of the image carrier by a predetermined gap;

electric field forming means for forming between said cleaning means and the image carrier an electric field for causing the toner to fly from said image carrier toward said cleaning means; and said toner having a mean volume grain size of 7 μm or less.

7. A cleaning device for an image forming apparatus and for removing toner left on an image carrier after a toner image has been transferred from said image carrier to a transfer medium, said device comprising:

cleaning means spaced apart from a surface of the image carrier by a predetermined gap;

electric field forming means for forming between said cleaning means and the image carrier an electric field for causing the toner to fly from said image carrier toward said cleaning means; and said cleaning means having a rotatable roller, said roller having a volume resistivity of $1\times10^3$ Ωcm or less.

8. A cleaning device for an image forming apparatus and for removing toner left on an image carrier after a toner image has been transferred from said image carrier to a transfer medium, said device comprising:

cleaning means spaced apart from a surface of the image carrier by a predetermined gap;

electric field forming means for forming between said cleaning means and the image carrier an electric field for causing the toner to fly from said image carrier toward said cleaning means; and the electric field formed by said electric field forming means being an alternating field, said alternating field having a DC offset having a peak-to-peak voltage in a direction for causing the toner to fly from the image carrier and lying in a range of from $2\times10^6$ V/m to $8\times10^6$ V/m.

9. A cleaning device for an image forming apparatus and for removing toner left on an image carrier after a toner image has been transferred from said image carrier to a transfer medium, said device comprising:

cleaning means spaced apart from a surface of the image carrier by a predetermined gap;

electric field forming means for forming between said cleaning means and the image carrier an electric field for causing the toner to fly from said image carrier toward said cleaning means; and the electric field formed by said electric field forming means being an alternating field having an amplitude ranging from $2\times10^6$ V/m to $2\times10^7$ V/m.

10. A cleaning device for an image forming apparatus and for removing toner left on an image carrier after a toner image has been transferred from said image carrier to a transfer medium, said device comprising:

cleaning means spaced apart from a surface of the image carrier by a predetermined gap;

electric field forming means for forming between said cleaning means and the image carrier an electric field for causing the toner to fly from said image carrier toward said cleaning means; and the electric field formed by said electric field forming means being an alternating field having a rectangular waveform.

11. A device as claimed in claim 10, wherein the alternating field has a duty ratio ranging from 1 to 5.

* * * * *